US008585037B1

(12) United States Patent
Jacobs

(10) Patent No.: US 8,585,037 B1
(45) Date of Patent: Nov. 19, 2013

(54) TANDEM MEDIA TRAY USING MID-TRAY SENSOR

(71) Applicant: Xerox Corporation, Norwalk, CT (US)

(72) Inventor: Jos Wim Jacobs, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/671,812

(22) Filed: Nov. 8, 2012

(51) Int. Cl.
*B65H 3/44* (2006.01)
*B65H 5/26* (2006.01)
*B65H 1/30* (2006.01)

(52) U.S. Cl.
USPC ..... 271/9.03; 271/9.12; 271/9.07; 271/158; 271/157

(58) Field of Classification Search
USPC ..... 271/9.12, 9.08, 9.03, 9.07, 157, 158
See application file for complete search history.

(56) References Cited

U.S. PATENT DOCUMENTS 5,102,112 A * 4/1992 Takahashi ..... 271/9.08
5,669,057 A 9/1997 Whiting
5,971,387 A * 10/1999 Kita ..... 271/9.03
6,032,004 A 2/2000 Mirabella, Jr. et al.
6,123,329 A 9/2000 Sato et al.
6,332,609 B1 * 12/2001 Arakawa ..... 271/157
7,618,037 B2 * 11/2009 Kang et al. ..... 271/157
7,654,514 B2 2/2010 Milillo
7,823,869 B2 * 11/2010 Ise ..... 271/9.03
7,866,654 B2 1/2011 Ohno
7,874,664 B2 1/2011 Gervasi et al.
8,186,665 B2 5/2012 Akema
8,267,395 B2 * 9/2012 Yang ..... 271/157
8,398,069 B2 * 3/2013 Chae et al. ..... 271/9.08

FOREIGN PATENT DOCUMENTS

JP 2000168968 6/2000
JP 2002338069 11/2002
JP 2002338126 11/2002

OTHER PUBLICATIONS

Park et al., U.S. Appl. No. 13/272,996, filed Oct. 13, 2011.

* cited by examiner

*Primary Examiner* — Luis A Gonzalez
(74) *Attorney, Agent, or Firm* — Gibb & Riley, LLC

(57) ABSTRACT

In a media tray, a mid-tray sensor is located relatively equally distant between the tray front and the tray back. This allows the tray to be free of a divider between the front and reserve stack areas. After the user closes the tandem tray, an elevator plate lifts media in the lead stack location and a slider moves in a forward direction toward the tray front based on the front media sensor not detecting media in the front stack area, or whenever the mid-tray sensor detects media located between the front stack area and the reserve stack area. An alarm is produced when the front media sensor does not detect any media, or when the slider is unable to move when it should be able to move (forward into the front stack area, back through the reserve stack area, etc.).

20 Claims, 6 Drawing Sheets

TANDEM MEDIA TRAY USING MID-TRAY SENSOR

BACKGROUND

Embodiments herein generally relate to devices that feed sheets of media, such as printing devices, etc., and more particularly to a tandem media tray (that holds multiple stacks of media sheets) that avoids the need for a divider between adjacent stacks of media sheets.

A sliding tandem media feeder is a media feeder that allows multiple stacks of media to be placed side by side in a media tray that uses a single feed-head. A reserve stack of media is pushed into a feed position by sliders after the original stack of media in the feed position has been depleted. Conventional tandem media trays can use a separating device (such as a divider or gate) between the stacks of media within the tray. The separating device can act as both a guide and a flag for a switch.

This separating device sometimes requires a motion system (e.g., solenoid or motor with sensors, etc.) to move the gate out of the way in order for the reserve stack to be slid into the feed position. Alternatively, a passive gate may be used that can be pushed out of the way by the moving media stack. However, any type of gate complicates the loading of the media in the tray since it requires precise placement of the media in order to be effective. In addition, a gate designed to constrain media may complicate the overall design of side guides and back stops in the tray since media of different sizes must be accommodated.

SUMMARY

In view of the issues that a tandem tray divider between media stacks presents, an exemplary tandem media tray herein has a mid-tray sensor located relatively equally distant between the tray front and the tray back. This allows the tray to be free of a divider between the front and reserve stack areas. With the structures and methods herein, a slider moves in a forward direction toward the tray front based on the front media sensor not detecting media in the front stack area, or whenever the mid-tray sensor detects media located between the front stack area and the reserve stack area. An alarm is produced when the front media sensor does not detect any media, or when the slider is unable to move when it should be able to move (forward into the front stack area, back through the reserve stack area, etc.).

More specifically, an exemplary printing and/or sheet-feeding apparatus herein comprises a printing engine, a media path feeding sheets of media to the printing engine, and a tray feeding the sheets of media to the sheet path. The tray has a tray front, a tray back located opposite the tray front, a first tray side between the tray front and the tray back, a second tray side between the tray front and the tray back located opposite the first tray side, and a tray floor connected to the tray front, the tray back, the first tray side, and the second tray side. Further, a first side guide is connected to the tray floor. The first side guide is parallel to the first tray side and is located relatively closer to the first tray side than the second tray side. Also, a second side guide is connected to the tray floor. The second side guide is parallel to the first side guide and to the second tray side. Further, the second side guide is located relatively closer to the second tray side than the first tray side.

Also, a mid-tray sensor is connected to the second side guide. The mid-tray sensor is located relatively equally distant between the tray front and the tray back. In one example, the mid-tray sensor comprises a protrusion that detects the presence of media based on the protrusion being moved by the media.

A slider is connected to the tray floor and is located relatively closer to the tray back than the tray front. The tray floor has a front stack area to hold a front stack of media between the mid-tray sensor and the tray front, and a reserve stack area to hold a reserve stack of media between the mid-tray sensor and the tray back. The range of the slider movement can be, for example, between the middle of the front stack area and a location within the tray back or the reserve stack area. Also, a front media sensor can be connected to the tray floor or can be located in the feed head assembly mounted above the tandem tray. The front media sensor is located relatively closer to the tray front than the tray back, and is located in the front stack area. In addition, a processor is operatively connected to the mid-tray sensor, the front media sensor, and the slider. This allows the tray to be free of a divider between the front stack area and the reserve stack area.

The processor commands a motor to moves the slider in a forward direction from the tray back toward the tray front based on the front media sensor not detecting media in the front stack area. The processor also moves the slider in the forward direction based on the mid-tray sensor detecting media being located between the front stack area and the reserve stack area. Further, a media elevator can be connected to the tray floor in the front stack area. The processor can pause the movement of the slider in the forward direction until the elevator is in a lowered position.

While moving the slider in the forward direction, the processor detects the reserve stack of media moving past the mid-tray sensor (based on input from the mid-tray sensor). After moving the slider into the front stack area, the processor moves the slider in a backward direction from the tray front (toward the tray back to a location within the reserve stack area or the tray back) based on the mid-tray sensor detecting the reserve stack of media moving fully into the front stack area.

The processor produces an alarm while moving the slider: whenever the slider moves into the front stack area and the front media sensor does not detect any media; whenever the slider is unable to move the reserve stack of media fully into the front stack area; and whenever the slider is unable to move in the backward direction through the reserve stack area when it attempts to do so.

An exemplary method of controlling the previously described sheet-feeding apparatus automatically moves the slider in a forward direction from the tray back toward the tray front based on the front media sensor not detecting media in the front stack area, using the processor, and automatically moves the slider in a forward direction from the tray back toward the tray front based on the mid-tray sensor detecting media being located between the front stack area and the reserve stack area, using the processor. This method can pause the moving of the slider in the forward direction until any optional elevator is in a lowered position. While moving the slider in the forward direction, this exemplary method automatically detects the reserve stack of media moving past the mid-tray sensor based on input from the mid-tray sensor, using the processor. After moving the slider into the front stack area, this exemplary method automatically moves the slider in a backward direction from the tray front toward the tray back based on the mid-tray sensor detecting the reserve stack of media moving fully into the front stack area, using the processor.

While moving the slider, this exemplary method automatically produces an alarm using the processor based on the slider moving into the front stack area and the front media sensor not detecting media, the slider being unable to move the reserve stack of media fully into the front stack area, and/or the slider being unable to move in the backward direction through the reserve stack area when it attempts to do so.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, conventional tandem media trays can use a separating device between the stacks of media within the tray. The structures and methods herein avoid the need for a divider between adjacent stacks of media sheets in a tandem tray by using a mid-tray sensor and a specialized detection methodology.

More specifically, the devices and methods herein use a mid-tray sensor that is positioned between the adjacent stacks of media sheets along with the methodology described below to keep the tray free of any dividers, separating devices, gates, etc. In one embodiment there is a single mid-position sensor flag, but those ordinarily skilled in the art would understand that multiple sensors could be used.

With the structures and methods herein, the user loads both stacks of media with the leading edge of the feed stack and the trailing edge of the reserve stack biased against the opposing walls of the tray. Thus, the inter-stack gap is different for different sized media. Further, with the different stacks being biased against the opposing walls of the tray, the rest position of the sliding backstop (which pushes the reserve stack into a feed position) can be biased against the wall of the tray. Requiring the user to bias the stacks against the front and back of the tray in conjunction with improved sensing features avoids the need for the user to precisely position the stacks differently depending on the different media sizes. Finally, the side guides of the structures herein, can simply move in one direction when switching between different sized media, which again increases user-friendliness.

Figure 1:
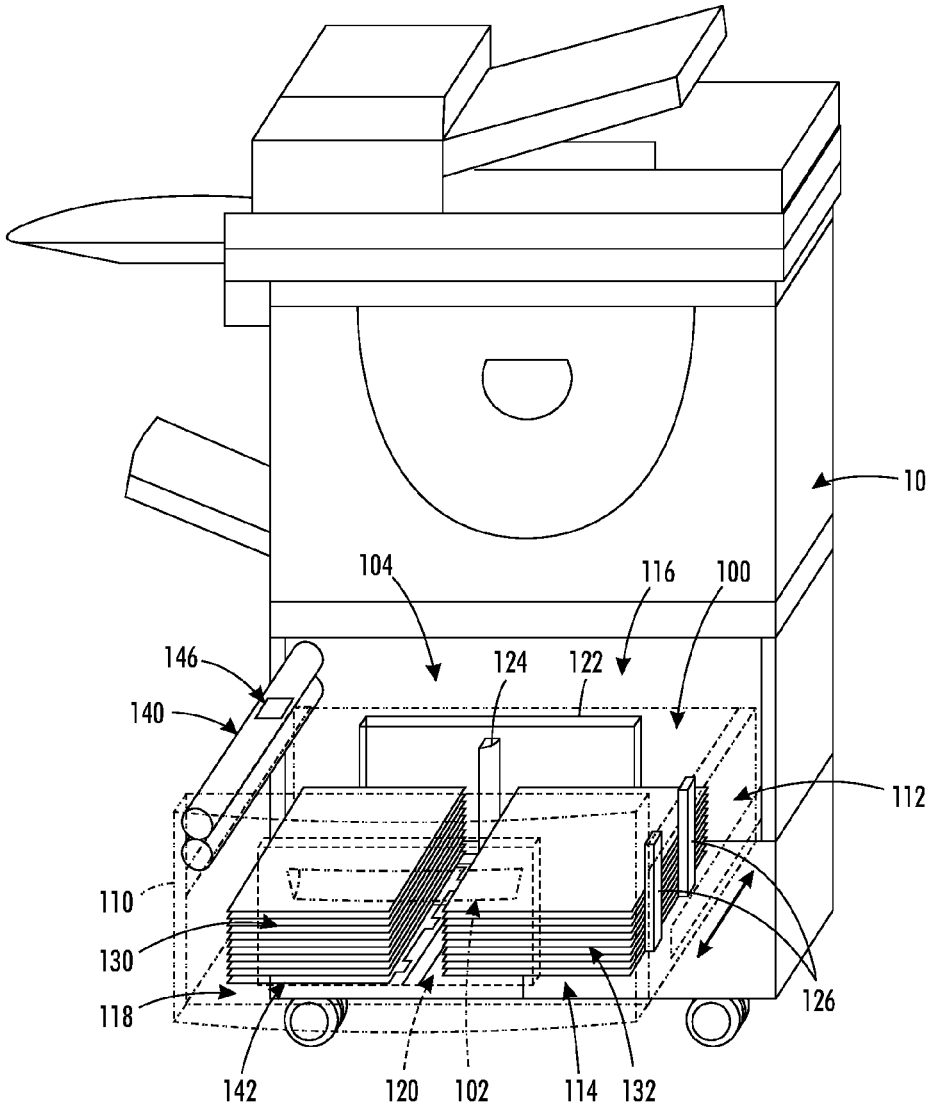
FIG. 1 is a perspective-view schematic diagram of a device according to embodiments herein.
Figure 2:
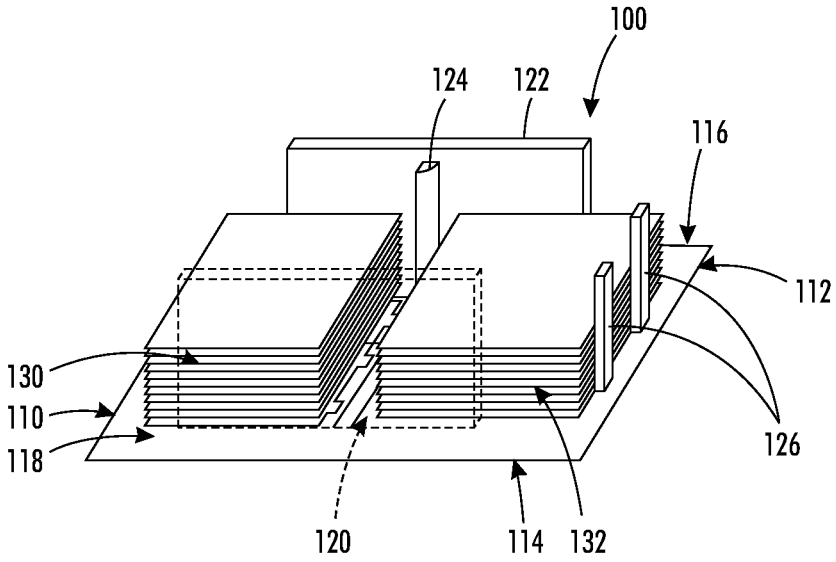
FIG. 2 is a perspective-view schematic diagram of a device according to embodiments herein.
Figure 3:
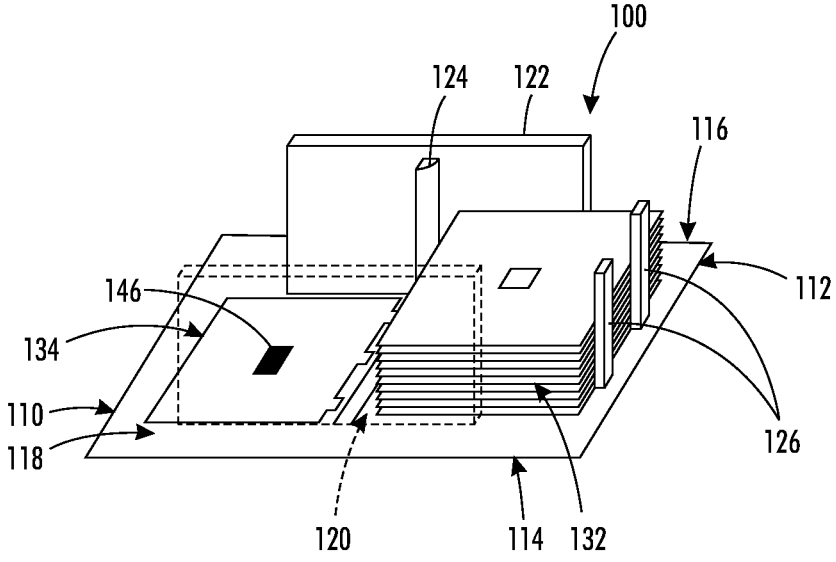
FIG. 3 is a perspective-view schematic diagram of a device according to embodiments herein.
Figure 4:
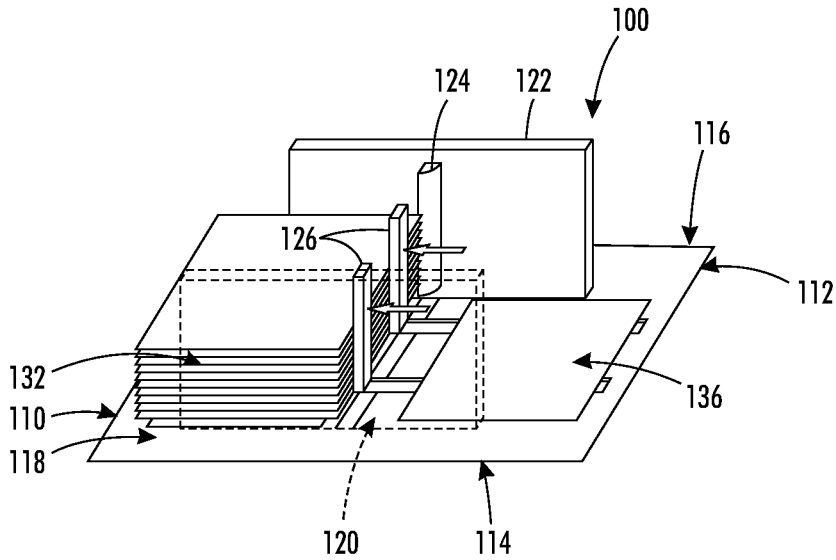
FIG. 4 is a perspective-view schematic diagram of a device according to embodiments herein.
Figure 5:
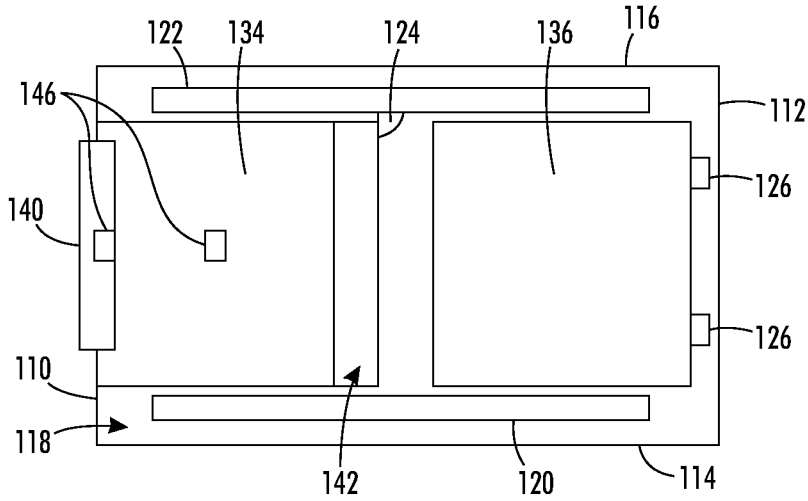
FIG. 5 is a top-view schematic diagram of a device according to embodiments herein.

FIGS. 1-5 show various views of the same tandem media tray 100 (some features of which are shown in shaded, transparent, or cut-away views in the drawings to ease understanding) according to the embodiments herein. FIG. 1 illustrates most structures of the tray 100 opened from the sheet feeding/printing device 10 disclosed herein. To reduce clutter, FIG. 2 is similar to FIG. 1, except that the tray sides, the printer, the feed head, etc., have been omitted. FIGS. 3 and 4 are similar to FIG. 2 and show the movement of media stacks within the tray. Finally, FIG. 5 is a top view showing the tray without any sheets loaded therein.

The exemplary printing and/or sheet-feeding apparatus 10 herein comprises a printing engine and a media path feeding sheets of media to the printing engine (see FIG. 8 below for details). The tray 100 is moved into or out of an opening 104 in the sheet feeding/printing device 10 (using the handle 102) to allow the user to add stacks of media to the tray 100. The tray 100 can use, for example, an elevator structure 142 and a picking system or feed head 140 (comprising belts, nip rollers, etc.) to feed the sheets of media to the sheet path within the sheet feeding/printing device 10. The feed head 140 pulls sheets from the stack of media located in the front stack area. The elevator system 142 is underneath the front stack so that the front stack can be elevated up to the feed head 140.

The tray 100 has an arbitrarily named tray front 110, a tray back 112 located opposite the tray front 110, a first tray side 114 between the tray front 110 and the tray back 112, and a second tray side 116 between the tray front 110 and the tray back 112 located opposite the first tray side 114. A tray floor 118 is connected to the tray front 110, the tray back 112, the first tray side 114, and the second tray side 116. Further, an adjustable first side guide 120 is connected to the tray floor 118. The first side guide 120 is parallel to the first tray side 114 and is located relatively closer to the first tray side 114 than the second tray side 116. Also, an adjustable second side guide 122 is connected to the tray floor 118. As shown, the second side guide 122 is parallel to the first side guide 120 and to the second tray side 116. Further, the second side guide 122 is located relatively closer to the second tray side 116 than the first tray side 114.

Also, a mid-tray sensor 124 is located relatively equally distant between the tray front 110 and the tray back 112. The mid-tray sensor 124 can be located on any surface within the tray, so long as it is in position to detect the presence or absence of sheets in the middle of the tray (between the stacks of media). For example, as shown in FIGS. 1-5, the mid-tray sensor 124 is connected to the second side guide 122. In one example, the mid-tray sensor 124 comprises a protrusion that detects the presence of the media based on the protrusion being moved by the media. Alternatively, the mid-tray sensor 124 could be a pressure sensor, an optical sensor, a sonic sensor, etc., or any combination of one or more such sensors.

A power driven slider 126 is connected to the tray floor 118 and is located relatively closer to the tray back 112 than the tray front 110. The range of the slider 126 movements can be, for example, between the middle of the front stack area 134 and a location within or against the tray back 112 or within the reserve stack area 136. Also, a front media sensor 146 could be connected to the tray floor 118 (as shown in FIGS. 3 and 5) and/or could be located in the feedhead 140 (as shown in FIGS. 1 and 5). For example, a sensor 146 in the feedhead can sense down into the tray when the media runs out. Therefore, item 146 is intended to illustrate all types of sensors that could be located at any location to detect media in the front portion of the tray. The front media sensor 146 is located relatively closer to the tray front 110 than the tray back 112, and is located in the front stack area 134. As would be understood by those ordinarily skilled in the art, other sensors could be included in the tray to detect the presence of the reserve stack 132, the position of the side guides 120-122, the position of the slider 126, the height of the media stacks, etc. Such sensors are not illustrated to reduce clutter in the drawings.

In addition, a processor 60 (FIG. 8) is operatively connected to the mid-tray sensor 124, the front media sensor, and the slider 126. The tray floor 118 has a front stack area 134 to hold a front stack of media 130 between the mid-tray sensor 124 and the tray front 110, and a reserve stack area 136 to hold a reserve stack of media 132 between the mid-tray sensor 124 and the tray back 112. This allows the tray to be free of a divider between the front stack area 134 and the reserve stack area 136.

As shown in FIG. 4, the processor moves the slider 126 in a forward direction from the tray back 112 toward the tray front 110 based on the front media sensor 146 not detecting media in the front stack area 134 (the situation shown in FIG. 3). The processor also moves the slider 126 in a forward direction from the tray back 112 toward the tray front 110 based on the mid-tray sensor 124 detecting media being located between the front stack area 134 and the reserve stack area 136. Further, a media elevator can be connected to the tray floor 118 in the front stack area 134. The processor pauses the moving of the slider 126 in the forward direction until the elevator is in a lowered position.

While moving the slider 126 in the forward direction, the processor detects the reserve stack of media 132 moving past the mid-tray sensor 124 (based on input from the mid-tray sensor 124 indicating that the leading edge of the reserve stack has passes by the mid-tray sensor 124). Thus, when the mid-tray sensor 124 is released (as the trailing edge of the reserve stack passes by the mid-tray sensor 124 while being moved forward by the slider 126) this alone can indicate that the slider 126 has properly moved the reserve stack 132 into the front stack area 134. Alternatively, or in combination with the mid-tray sensor 124 being released during movement of the reserve stack 132 forward, a current spike sensed in the motor driving the slider 126 can indicate that the reserve stack is fully against the tray front 110. Further, if a current spike is sensed in the motor driving the slider 126 while moving during movement of the reserve stack 132 forward, but the mid-tray sensor 124 has not been released (the mid-tray sensor 124 still senses the presence of the stack), this indicates that a jam has occurred because resistance is being experienced by the slider (causing the current spike) showing that the stack is not moving (or not moving as easily as it should), yet a portion of the stack is still pressing against the mid-tray sensor 124.

Thus, the structures and methods herein indicate a jam when the reserve stack 132 cannot be properly moved, yet the stack is still positioned on the mid-tray sensor 124. Using the mid-tray sensor 124 in this manner allows the same structure to automatically accommodate all different paper sizes as long as the side-to-side length is the same, without any physical adjustment of guides, gates, or other structures. For this description the side-to-side length of the media is the distance between the side guides 120 and 122. This is valid for other side-to-side lengths, so long as the side guides are moved. Instead of making physical adjustment of guides, gates, or other structures, before inserting a stack of media with different width, the reserve stack 132 into the front stack area 134 the methods and systems herein detect a current increase or spike caused by the slider 126 in combination with no stack being sensed by the mid-tray sensor 124 (after a stack was previously sensed during the stack move) to indicate that the slider has properly moved the reserve stack 132 into the front stack area 134, irrespective of the size of the paper in the stack. When this occurs, instead of making physical adjustment of guides, gates, or other structures, the structures and methods herein reset the slider position to the home position at the tray back 112. Further, the slider motor does not need any precise positioning, irrespective of media size, because the slider current detection and mid-tray sensor 124 accommodate for all media sizes. Thus, without a center divider or gate (and without making physical adjustment of front-back guides, gates, or other structures) the structures and methods herein can accommodate all appropriate media lengths (where the "length" of the sheet is measured in a direction between the tray front 110 and the tray back 112) with the use of a single mid-tray sensor and a method that includes requiring the user to place stacks at the extreme front and back locations of the tandem tray. The side guides 120, 122 would still have to be adjusted for media of different widths (where the "width" of the sheet is measured in a direction between the first and second sides 114, 116).

After moving the slider 126 into the front stack area 134, the processor moves the slider 126 in a backward direction from the tray front 110 (toward the tray back 112 to a location between the reserve stack area 136 and the tray back 112) based on the mid-tray sensor 124 detecting the reserve stack of media 132 moving fully into the front stack area 134.

The processor produces an alarm (including an audible alarm and/or a visual alarm like a message on the user interface, etc.) while moving the slider 126: whenever the slider 126 moves into the front stack area 134 and the front media sensor does not detect any media; whenever the slider 126 is unable to move the reserve stack of media 132 fully into the front stack area 134; and whenever the slider 126 is unable to move in the backward direction through the reserve stack area 136 when it attempts to do so.

With embodiments herein, user manuals, display screens, signs, and labels direct the user to always place the media stacks against the tray front 110 or against the sliders 126. Thus, the user places the stacks as far apart as possible from each other in the tandem tray 100. This maximizes the space between the stacks, and avoids the need for a divider to separate the media stacks within the tray. Further, this additional space between the stacks makes it easier for the user to load media correctly. Also, this placement of the stacks against the front and back of the tray works for all sheet sizes (possibly with adjustment of the side guides 120-122) without having to adjust any structures in the front-back direction (the direction of the slider 126 travel shown in FIG. 4).

As shown in FIG. 4, the reserve stack of media 132 is automatically pushed into a feed position 134 after the original stack of media 130 in the feed position 134 has been depleted. The sliding backstop 126 moves the reserve stack of media 132 over to the front stack area 134, and then returns to its original position against (or within) the tray back 112.

In one embodiment, the single mid-position sensor flag 124, positioned in the middle of the free space between the stacks, is used to detect media in the middle of the tray. The sensor flag 124 could be reduced to a small lever only, instead of covering the full height of the stack as shown in the Figures. Because of the location in the middle of the space between both stacks, it is very unlikely that that the mid-tray sensor 124 will be triggered inadvertently.

In this implementation, the side media guides 120, 122 are the only parts that have to be moved when switching paper sizes (e.g., from A to A4). By having the user place the stacks at the extreme front and back of the tray ensures that the mid sensor flag 124 remains in the same lateral position. This action is simple and can be done by the user without much guidance except for label, etc., explaining how to load stacks of media.

When the tray is empty (both stacks are depleted), the user opens the tray and puts two stacks of (e.g., two 500 sheet stacks) reams in place as described above. The user then closes the tray 100. If the mid position sensor is not activated, the elevator plate 142 starts lifting the front stack of media 130. The tray 100 is then ready to feed media as soon as the media in place, as detected by a sensor 146 in the feed head 140.

When moving the media sheet forward (and/or lifting the media), if the media present sensor 146 does not trigger within a predetermined time, then the sliding backstop 126 (sometimes just referred to as a "slider") moves to the left to move a reserve stack of media 132 onto the elevator plate 142. The tray 100 also goes into this mode if there was no media in the front stack area 134 when the user closed the tray. The mid-tray sensor 124 should trigger as soon as the slider 126 starts moving as the leading edge of the moving reserve stack of media 132 moves across the mid-tray sensor 124. However, if the mid-tray sensor 124 does not trigger when the slider moves to the front stack area 134, the processor moves the slider 126 to its home position against or within the tray back 112. If the slider 126 cannot move to its home position, an alarm is produced to declare a jam. On the other hand, if the slider reaches its home position, then that means that there was no media in the tray at all, and a no-paper (or no-media) alarm or message is produced.

When the mid-position sensor triggers as expected when the reserve stack of media 132 is being moved to the front stack area, then the systems and methods herein temporarily stop the slider for a predetermined amount of time to allow the elevator plate 142 to drop down. The slider 126 then continues to move the reserve media stack 132 to the front stack area 134. Just before the reserve media stack 132 is positioned fully within the front stack area 134 (against the tray front 110), the trail edge of the reserve stack 132 will release the mid-tray sensor 124 (indicating that the area in front of the mid-tray sensor 124 is free of media sheets). If that does not happen the slider 126 was not able to fully move into the front stack area 134 and a jam occurred, and an appropriate alarm is produced. In the other case the tray logic starts looking for the media stack 132 to reach its feed position in the front stack area 134. The slider 126 then returns to the home position and the tandem tray 100 is then ready to feed again.

Another possibility is that the mid-tray sensor 124 is triggered when the user closes the tray (which would occur when the user loaded a stack in-between the front stack area 134 and the reserve stack area 136). In this case, the slider 126 moves to the left to move a (new) stack of media onto the elevator plate 142. The slider 126 will move the media to the left and will keep doing so until it sees the mid-tray sensor 124 un-trigger or time out. If the mid-tray sensor 124 times out, then the tray believes there is a jam (there was media put in the wrong place and the slider cannot push it in the right place) and the slider 126 will move to its home position as described above. If the mid-tray sensor 124 un-triggers, then that means that the media that was positioned in the middle of the tray, is now moving in its feed position in the front stack area 134 and the tray can resume its standard process as described above.

Figure 6:
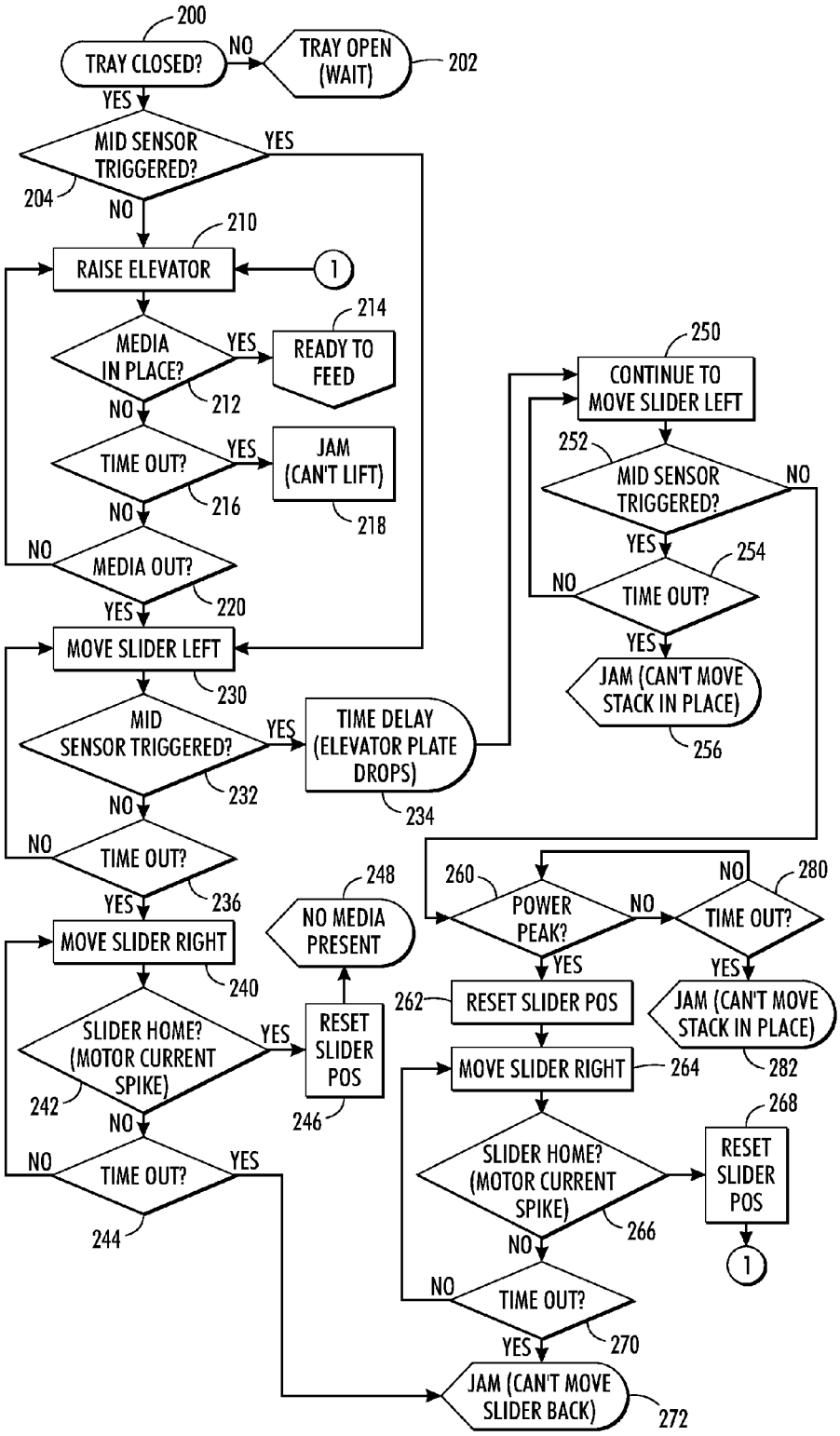
FIG. 6 is a flow diagram illustrating various embodiments herein.

This processing is shown in flowchart form in FIG. 6. More specifically, in FIG. 6, processing begins with item 200 where a sensor determines whether the tray is closed. If it is not, item 202 waits for the tray to be closed. Item 204 determines whether the mid-tray sensor is triggered. If it is not, item 210 raises the elevator to move the front stack of media toward the feed head. Item 212 determines whether the media is in place, and if it is, item 214 indicates that the media is ready to be fed into the sheet feeding or printing apparatus. If a timeout occurs before the media is in place (as determined by item 216) a jam is indicated in item 218. Otherwise a media out condition is indicated by item 220. This condition is detected when the elevator plate position sensor in the feedhead detects the lift plate being in position while the media present sensor 146 does not see any media.

If the mid-tray sensor was triggered in item 204 or if there was no media in the lead stack position, processing proceeds to item 230 where the slider is moved toward the front of the tray. In item 232, it is again determined whether the mid-tray sensor is triggered. (The lead stack was empty, ran out of media, or the user put a stack in the middle of the tray) If it is not, the slider continues to move to the left until a timeout is recorded by item 236. If the mid-tray sensor is triggered in item 232, a time delay is instituted in item 234 to allow the elevator plate to drop. The tray is now trying to put the reserve stack in position for lifting and then feeding.

If there is a timeout in item 236, processing proceeds to item 240, which moves the slider to the right (to the back of the tray). In item 242, it is determined whether the slider has reached the back of the tray (the home position). If it has not, a timeout is elapsed through item 244 while the slider continues to move toward the back of the tray. Once the slider has reached the home position, the slider position is reset to the home position in item 246, and this also indicates that there is no media present (and item 248 produces an alarm indicating the absence of media).

After the elevator is allowed to drop in item 234, processing proceeds to item 250 where the movement of the slider toward the front of the tray (to the left) is resumed. Item 252 checks to see whether the mid-tray sensor is triggered and item 254 continues checking for the mid-tray sensor to be triggered while it is being moved toward the front of tray. If the timeout is exceeded in item 254, processing in item 256 produces an alarm that there is a jam because the slider cannot move to the appropriate forward position in the tray.

If, however, the mid-tray sensor is not triggered in item 252 (as the slider is moving toward the front of the tray in item 250) processing proceeds to item 160 to check for a power peak. More specifically, in item 260, such a power peak would indicate that the slider is attempting to move, but is being resisted by some item and is drawing excess power in this effort. If this occurs in item 260, the processing resets the slider to the home position in item 262 and then attempts to move the slider toward the back of the tray in item 264. If the slider does not reach its home position in item 266 (after a sufficient timeout in item 270), a jam is declared (because the slider cannot move properly to the back portion of the tray) in item 272 as an alarm.

If there is not a power peak as determined in item 260, the slider movement toward the front of the tray (in item 250) is monitored until a timeout occurs in item 280. If the timeout occurs in item 280, this indicates that there is a jam within the tray and that the slider cannot move the stack of media toward the front of the tray (and item 282 produces an appropriate alarm in this situation). If the slider reaches the home position in item 266, the slider position is reset to the home position in item 268 and processing returns to item 210 to raise the elevator to allow the newly loaded reserve sheet to be sent into the sheet processing device or printing device. Thus, the above structure and method determine if there is any media in the reserve stack.

Also, the tandem tray detects a stack left in the middle and the slider will move to the left until the stack is in moved into place on the elevator plate. There are several ways media can get in the middle of the tray and trigger the mid position sensor when a user closes the tray. For example, the user can simply mistakenly put a stack in the middle (A3 media for example) when loading the media. Another way for media to be in the middle of the tray is if the machine loses power in the middle of a stack move. Another possibility is that the user loads a stack only on the reserve stack and then opens the tray again to see what it is occurring during stack moving. In all such cases, the structures and methods herein first move the slider to the front of the tray in order to get the stack onto the elevator plate. Then, if the slider properly loads the stack, feeding is set to commence. Also, the slider next attempts to reach its home position at the back of the tray and, if it does feeding commences; however, if it does not, a jam alarm is indicated.

Figure 7:
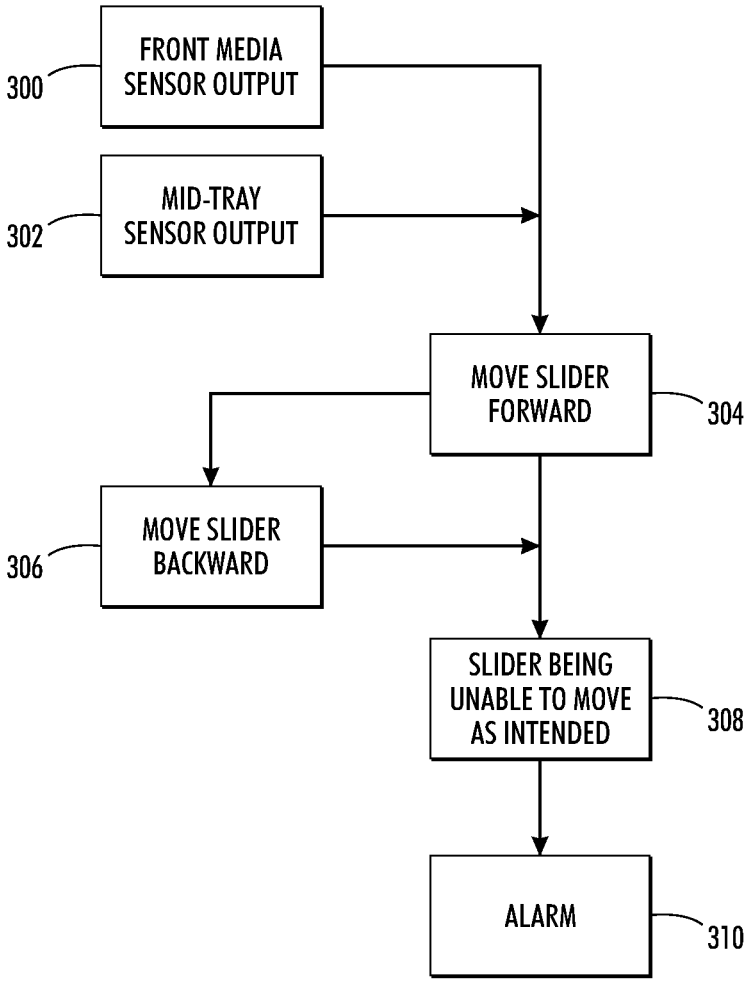
FIG. 7 is a flow diagram illustrating various embodiments herein.

Thus, with structures and methods herein, the slider motor does not need any precise positioning as its positioning is reset after each complete move forward or backward. This is the direct result of biasing the stacks of media against the front and back walls of the tray and varying the inter stack gap when switching between media sizes, for example, between A and A4. Additionally, the structures and methods herein use less components by using a single mid-tray sensor and eliminating a divider or gate. Further, with structures and methods herein the media is much easier to load because there are no guides in the middle of the tray that limit the available space. This also makes the set up much more robust against false triggers of the mid-tray sensor. Further, the structures and methods herein provide quick detection of whether or not there is media loaded in the reserve stack and quick detection of media left in the middle FIG. 7 is simplified relationship chart illustrating another exemplary method herein. Item 300 represents the presence or absence of media detected by the front media sensor 146 (which, again, could be in the feedhead and/or the tray floor, as shown in FIG. 5). Item 302 represents the presence or absence of media detected by the mid-tray media sensor 124.

In item 304, this method moves the slider in a forward direction from the tray back toward the tray front based on the front media sensor not detecting media in the front stack area in item 300. Item 304 also automatically moves the slider in a forward direction from the tray back toward the tray front based on the mid-tray sensor detecting media being located between the front stack area and the reserve stack area in item 302 (mid-tray sensor being triggered). Item 304 can pause the moving of the slider in the forward direction until any optional elevator is in a lowered position.

While moving the slider in the forward direction in item 304, this exemplary method automatically detects the reserve stack of media moving past the mid-tray sensor based on input from the mid-tray sensor 302. After moving the slider into the front stack area, this exemplary method automatically moves the slider in a backward direction from the tray front toward the tray back based on the mid-tray sensor detecting the reserve stack of media moving fully into the front stack area as shown in item 306.

While moving the slider in item 304, this exemplary method automatically produces an alarm 310 using the processor based on the slider moving into the front stack area and the front media sensor 146 not detecting media. Also, item 310 produces an alarm (based on item 308) if the slider is unable to move the reserve stack of media fully into the front stack area in 304, or if the slider is unable to move in the backward direction through the reserve stack area when it attempts to do so in item 306.

Figure 8:
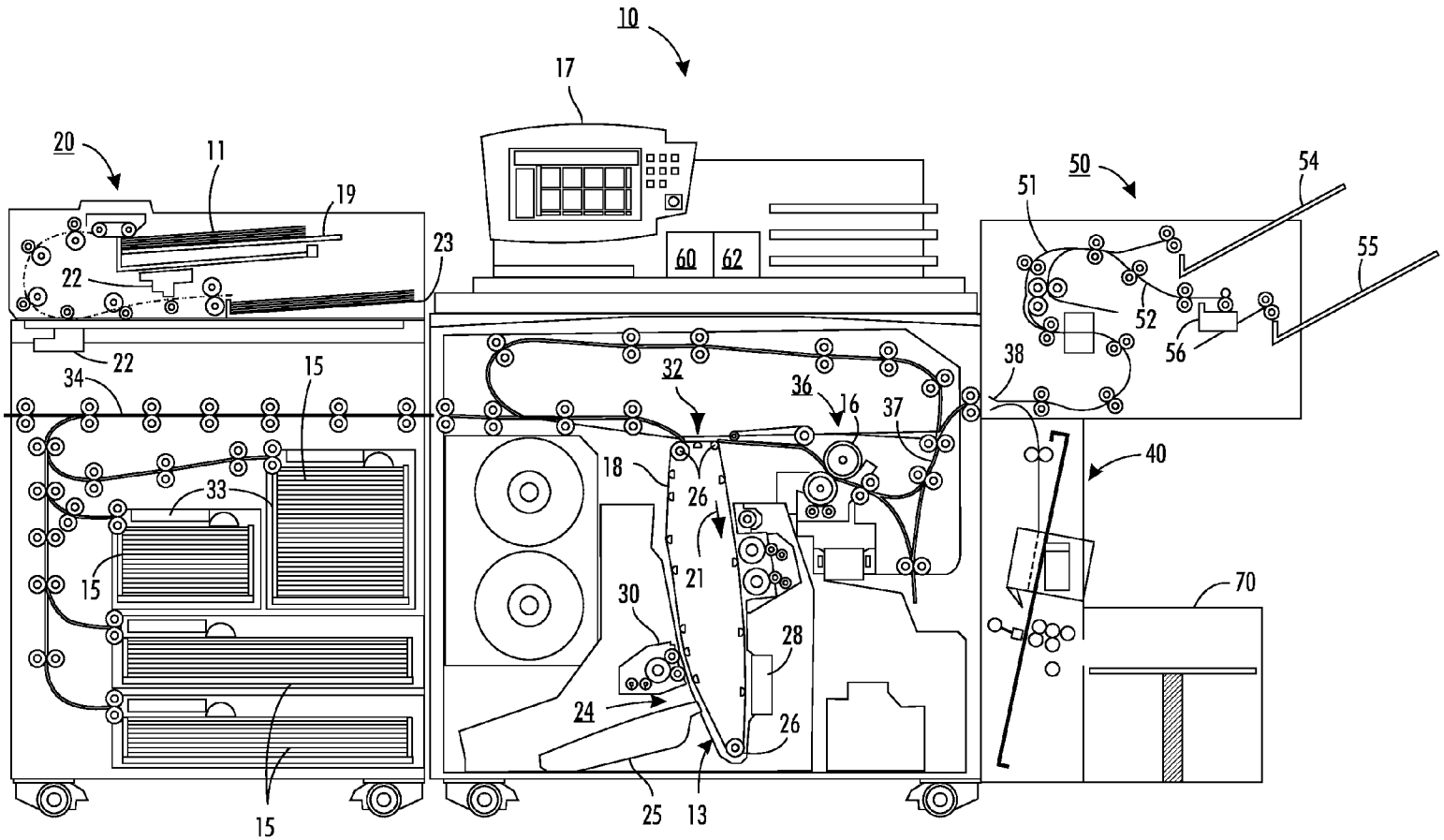
FIG. 8 is a side-view schematic diagram of a device according to embodiments herein.

Referring to FIG. 8, a printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing station 30, and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices which contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 8 is only one example and the embodiments herein are equally applicable to other types of printing devices that may include fewer components or more components. For example, while a limited number of printing engines and paper paths are illustrated in FIG. 8, those ordinarily skilled in the art would understand that many more paper paths and additional printing engines could be included within any printing device used with embodiments herein.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. Nos. 6,032,004, and 7,874,664 the complete disclosures of which are fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the embodiments herein cannot be implied or imported from any above example as limitations to any particular order, number, position, size, shape, angle, color, or material.

What is claimed is:

1. A sheet-feeding apparatus comprising:

a tray having a tray front, a tray back opposite said tray front, and tray sides between said tray front and said tray back;

a mid-tray sensor located relatively equally distant between said tray front and said tray back;

a slider connected to said tray;

a front media sensor connected to said tray, said front media sensor being located relatively closer to said tray front than said tray back; and a processor operatively connected to said mid-tray sensor, said front media sensor, and said slider, a tray floor comprising a front stack area to hold a front stack of media between said mid-tray sensor and said tray front, and a reserve stack area to hold a reserve stack of media between said mid-tray sensor and said tray back, said tray being free of a divider between said front stack area and said reserve stack area, said processor moving said slider in a forward direction from said tray back toward said tray front based on said front media sensor not detecting media in said front stack area, said processor moving said slider in a forward direction from said tray back toward said tray front based on said mid-tray sensor detecting media being located between said front stack area and said reserve stack area, while moving said slider in said forward direction, said processor detecting said reserve stack of media moving past said mid-tray sensor based on input from said mid-tray sensor, after said moving of said slider into said front stack area, said processor moving said slider in a backward direction from said tray front toward said tray back based on said mid-tray sensor detecting said reserve stack of media moving fully into said front stack area, and while moving said slider, said processor producing an alarm based on at least one of:

said slider moving into said front stack area and said front media sensor not detecting media;

said slider being unable to move said reserve stack of media fully into said front stack area; and said slider being unable to move in said backward direction through said reserve stack area.

2. The sheet-feeding apparatus according to claim 1, said mid-tray sensor comprising a protrusion, said protrusion detecting a presence of said media based on said protrusion being moved by said media.

3. The sheet-feeding apparatus according to claim 1, further comprising a media elevator in said front stack area.

4. The sheet-feeding apparatus according to claim 3, said processor pausing said moving of said slider in said forward direction until said elevator is in a lowered position.

5. The sheet-feeding apparatus according to claim 1, a range of said slider movement being between said front stack area and a location between said tray back and said reserve stack area.

6. A sheet-feeding apparatus comprising:

a tray having a tray front, a tray back located opposite said tray front, a first tray side between said tray front and said tray back, a second tray side between said tray front and said tray back located opposite said first tray side, and a tray floor connected to said tray front, said tray back, said first tray side, and said second tray side;

a first side guide connected to said tray floor, said first side guide being parallel to said first tray side and being located relatively closer to said first tray side than said second tray side;

a second side guide connected to said tray floor, said second side guide being parallel to said second tray side and being located relatively closer to said second tray side than said first tray side;

a mid-tray sensor connected to said second side guide, said mid-tray sensor being located relatively equally distant between said tray front and said tray back;

a slider connected to said tray floor and being located relatively closer to said tray back than said tray front;

a front media sensor connected to said tray floor, said front media sensor being located relatively closer to said tray front than said tray back; and a processor operatively connected to said mid-tray sensor, said front media sensor, and said slider, said tray floor comprising a front stack area to hold a front stack of media between said mid-tray sensor and said tray front, and a reserve stack area to hold a reserve stack of media between said mid-tray sensor and said tray back, said tray being free of a divider between said front stack area and said reserve stack area, said processor moving said slider in a forward direction from said tray back toward said tray front based on said front media sensor not detecting media in said front stack area, said processor moving said slider in a forward direction from said tray back toward said tray front based on said mid-tray sensor detecting media being located between said front stack area and said reserve stack area, while moving said slider in said forward direction, said processor detecting said reserve stack of media moving past said mid-tray sensor based on input from said mid-tray sensor, after said moving of said slider into said front stack area, said processor moving said slider in a backward direction from said tray front toward said tray back based on said mid-tray sensor detecting said reserve stack of media moving fully into said front stack area, and while moving said slider, said processor producing an alarm based on at least one of:

said slider moving into said front stack area and said front media sensor not detecting media;

said slider being unable to move said reserve stack of media fully into said front stack area; and said slider being unable to move in said backward direction through said reserve stack area.

7. The sheet-feeding apparatus according to claim 6, said mid-tray sensor comprising a protrusion, said protrusion detecting a presence of said media based on said protrusion being moved by said media.

8. The sheet-feeding apparatus according to claim 6, further comprising a media elevator in said front stack area.

9. The sheet-feeding apparatus according to claim 8, said processor pausing said moving of said slider in said forward direction until said elevator is in a lowered position.

10. The sheet-feeding apparatus according to claim 6, a range of said slider movement being between said front stack area and a location between said tray back and said reserve stack area.

11. A printing apparatus comprising:

a printing engine;

a media path feeding sheets of media to said printing engine;

a tray feeding said sheets of media to said sheet path, said tray having a tray front, a tray back opposite said tray front, and tray sides between said tray front and said tray back;

a mid-tray sensor located relatively equally distant between said tray front and said tray back;

a slider connected to said tray;

a front media sensor connected to said tray, said front media sensor being located relatively closer to said tray front than said tray back; and a processor operatively connected to said mid-tray sensor, said front media sensor, and said slider, a tray floor comprising a front stack area to hold a front stack of media between said mid-tray sensor and said tray front, and a reserve stack area to hold a reserve stack of media between said mid-tray sensor and said tray back, said tray being free of a divider between said front stack area and said reserve stack area, said processor moving said slider in a forward direction from said tray back toward said tray front based on said front media sensor not detecting media in said front stack area, said processor moving said slider in a forward direction from said tray back toward said tray front based on said mid-tray sensor detecting media being located between said front stack area and said reserve stack area, while moving said slider, said processor detecting said reserve stack of media moving past said mid-tray sensor based on input from said mid-tray sensor, after said moving of said slider into said front stack area, said processor moving said slider in a backward direction from said tray front toward said tray back based on said mid-tray sensor detecting said reserve stack of media moving fully into said front stack area, and while moving said slider, said processor producing an alarm based on at least one of:

said slider moving into said front stack area and said front media sensor not detecting media;

said slider being unable to move said reserve stack of media fully into said front stack area; and said slider being unable to move in said backward direction through said reserve stack area.

12. The printing apparatus according to claim 11, said mid-tray sensor comprising a protrusion, said protrusion detecting a presence of said media based on said protrusion being moved by said media.

13. The printing apparatus according to claim 11, further comprising a media elevator in said front stack area.

14. The printing apparatus according to claim 13, said processor pausing said moving of said slider in said forward direction until said elevator is in a lowered position.

15. The printing apparatus according to claim 11, a range of said slider movement being between said front stack area and a location between said tray back and said reserve stack area.

16. A method of controlling a sheet-feeding apparatus, said sheet feeding apparatus comprising:

a tray having a tray front, a tray back opposite said tray front, and tray sides between said tray front and said tray back;

a mid-tray sensor located relatively equally distant between said tray front and said tray back;

a slider connected to said tray;

a front media sensor connected to said tray, said front media sensor being located relatively closer to said tray front than said tray back; and a processor operatively connected to said mid-tray sensor, said front media sensor, and said slider, a tray floor comprising a front stack area to hold a front stack of media between said mid-tray sensor and said tray front, and a reserve stack area to hold a reserve stack of media between said mid-tray sensor and said tray back, said tray being free of a divider between said front stack area and said reserve stack area, said method comprising:

automatically moving said slider in a forward direction from said tray back toward said tray front based on said front media sensor not detecting media in said front stack area, using said processor, automatically moving said slider in a forward direction from said tray back toward said tray front based on said mid-tray sensor detecting media being located between said front stack area and said reserve stack area, using said processor, while moving said slider in said forward direction, automatically detecting said reserve stack of media moving past said mid-tray sensor based on input from said mid-tray sensor, using said processor after said moving of said slider into said front stack area, automatically moving said slider in a backward direction from said tray front toward said tray back based on said mid-tray sensor detecting said reserve stack of media moving fully into said front stack area, using said processor, and while moving said slider, automatically producing an alarm using said processor based on at least one of:

said slider moving into said front stack area and said front media sensor not detecting media;

said slider being unable to move said reserve stack of media fully into said front stack area; and said slider being unable to move in said backward direction through said reserve stack area.

17. The method of controlling a sheet-feeding apparatus according to claim 16, said mid-tray sensor comprising a protrusion, said method further comprising detecting a presence of said media based on said protrusion being moved by said media.

18. The method of controlling a sheet-feeding apparatus according to claim 16, said sheet feeding apparatus further comprising a media elevator in said front stack area.

19. The method of controlling a sheet-feeding apparatus according to claim 18, said method further comprising pausing said moving of said slider in said forward direction until said elevator is in a lowered position, using said processor.

20. The method of controlling a sheet-feeding apparatus according to claim 16, a range of said slider movement being between said front stack area and a location between said tray back and said reserve stack area.

* * * * *